US006783465B2

(12) United States Patent
Matsunaga

(10) Patent No.: US 6,783,465 B2
(45) Date of Patent: Aug. 31, 2004

(54) GOLF CLUB HEAD

(75) Inventor: Hideo Matsunaga, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/244,505

(22) Filed: Sep. 17, 2002

(65) Prior Publication Data

US 2003/0114244 A1 Jun. 19, 2003

(30) Foreign Application Priority Data

Sep. 20, 2001 (JP) ..... P2001-287225

(51) Int. Cl.[7] ..... A63B 53/04
(52) U.S. Cl. ..... 473/329; 473/345; 473/346
(58) Field of Search ..... 473/324, 327, 473/328, 330, 331, 345, 346, 349, 350, 332, 329

(56) References Cited

U.S. PATENT DOCUMENTS

| | | | | | |
|---|---|---|---|---|---|
| 4,065,133 | A | * | 12/1977 | Gordos | 473/327 |
| 4,139,196 | A | * | 2/1979 | Riley | 473/242 |
| 4,754,974 | A | * | 7/1988 | Kobayashi | 473/327 |
| 5,090,702 | A | * | 2/1992 | Viste | 473/331 |
| 5,092,599 | A | * | 3/1992 | Okumoto et al. | 473/327 |
| 5,180,166 | A | * | 1/1993 | Schmidt et al. | 473/332 |
| 5,351,958 | A | * | 10/1994 | Helmstetter | 473/346 |
| 5,474,297 | A | * | 12/1995 | Levin | 473/328 |
| 5,511,786 | A | * | 4/1996 | Antonious | 473/327 |
| 5,611,742 | A | * | 3/1997 | Kobayashi | 473/345 |
| 5,921,872 | A | * | 7/1999 | Kobayashi | 473/345 |
| 6,001,029 | A | * | 12/1999 | Kobayashi | 473/327 |
| 6,348,013 | B1 | * | 2/2002 | Kosmatka | 473/329 |

FOREIGN PATENT DOCUMENTS

| | | | | |
|---|---|---|---|---|
| JP | 0000538 | * | 1/1977 | 273/167 E |
| JP | 4-82574 | | 3/1992 | |
| JP | 404180778 | * | 6/1992 | 273/167 E |
| JP | 8-126723 | | 5/1996 | |
| JP | 2001-353240 | | 12/2001 | |
| JP | 2002-113134 | | 4/2002 | |

* cited by examiner

*Primary Examiner*—Sebastiano Passaniti
(74) *Attorney, Agent, or Firm*—Sughrue Mion, PLLC

(57) ABSTRACT

A hollow golf club head made of metal has a face portion made of a titanium alloy, a crown portion, a sole portion, a toe-side side portion, a back-side side portion, a heel-side side portion, and a hosel portion. Grooves are provided in the crown portion so as to extend in the direction connecting the heel side and the toe side. Ribs are provided in the sole portion so as to extend in the direction connecting the face portion and the back-side side portion.

26 Claims, 3 Drawing Sheets

GOLF CLUB HEAD

This disclosure relates to the subject matter contained in Japanese Patent Application No.2001-287225 filed on Sep. 20, 2001, which is incorporated herein by reference in its entirety.

BACKGROUND OF THE INVENTION

1. Field of the Invention

The present invention relates to a hollow golf club head made of metal, and particularly relates to a golf club head having a wood type shape or a shape close to the wood type shape.

2. Description of the Related Art

Hollow golf club heads made of metal are used widely as wood type golf club heads such as drivers or fairway woods. Generally, as shown in FIG. 6, a hollow wood type golf club head 1' has a face portion 2 for hitting a ball, a crown portion 3 forming the top surface portion of the golf club head, a sole portion 4 forming the bottom surface portion of the golf club head, toe-side, back-side and heel-side side portions 5*a*, 5*b* and 5*c* forming the toe-side, back-side and heel-side side surface portions of the golf club head respectively, and a hosel portion 6. A shaft 7 is inserted into the hosel portion 6 of the golf club head 1', and fixed thereto by a bonding agent or the like. Incidentally, recently, a lot of golf club heads called utility clubs have come onto the market. As a kind of such utility golf club head, various golf club heads resembling the wood type golf club head (that is, having a face portion, a sole portion, respective side portions and a crown portion) have also come onto the market.

As metal forming such a hollow golf club head, aluminum alloys, stainless steel, or titanium alloys are used. In recent years, titanium alloys are especially used widely.

In order to increase a carry of a shot with a hollow golf club head made of metal, development has been made while attention has been paid to the fact that the repulsion of a ball is increased by use of the bending of a face surface so as to hit the ball farther. However, for a golfer who has a low head speed, the deformation of the face surface in a golf club head of this type is insufficient so that the effect to increase the initial speed of the ball is reduced. In addition, the ball cannot be launched high. Thus, the carry may be not increased.

It is an object of the invention to provide a golf club head in which, even if a golfer who has a low head speed uses the golf club head, the launch angle is increased so that the carry can be increased consequently.

BRIEF SUMMARY OF THE INVENTION

A hollow golf club head according to the invention is made of metal. The golf club has a face portion, a sole portion, a toe-side side portion, a heel-side side portion, a back-side side portion, a crown portion, and a hosel portion. A plurality of grooves are defined in the crown portion to extend from the toe-side side portion toward the heel-side side portion.

In the golf club head configured thus according to the invention, the crown portion is easily bent at the time of impact by the operation of the grooves provided in the crown portion. Accordingly, even if a beginner or a powerless player who has a low head speed uses the golf club head, the initial speed of a ball increases while the backspin rate increases and the launch angle also increases. Thus, these operations are superposed on one another so as to increase the carry.

The grooves in the crown portion may extend substantially straight lines from the toe-side side portion toward the heel-side side portion, or may be formed in curved lines and be bent to bulge toward the back-side side portion.

According to the invention, it is preferable that the highest portion of the crown portion excluding the hosel portion is located between two of the grooves. With such a configuration, the stress applied to the crown portion at the time of impact is dispersed over a wide region of the crown portion so that the crown portion as a whole is bent. Thus, large repulsive force can be generated.

According to the invention, ribs may be provided in the sole portion so as to extend from the face portion toward the back-side side portion, or salient portions may be provided on the bottom surface of the sole portion so as to angulate and extend from the face portion toward the back-side side portion, so that the deformation of the sole portion at the time of impact is suppressed. Thus, the stress is concentrated on the crown portion at the time of impact so that the crown portion becomes easier to bend. As a result, the carry increases further.

It is preferable to apply the invention to a large-sized golf club head having a volume over 250 cc, especially over 300 cc, more especially over 350 cc. An example of such a golf club head is a driver. However, the invention is also applicable to a fairway wood, a utility golf club head resembling wood type one, and the like.

DETAILED DESCRIPTION OF THE PREFERRED EMBODIMENTS

Figure 1:
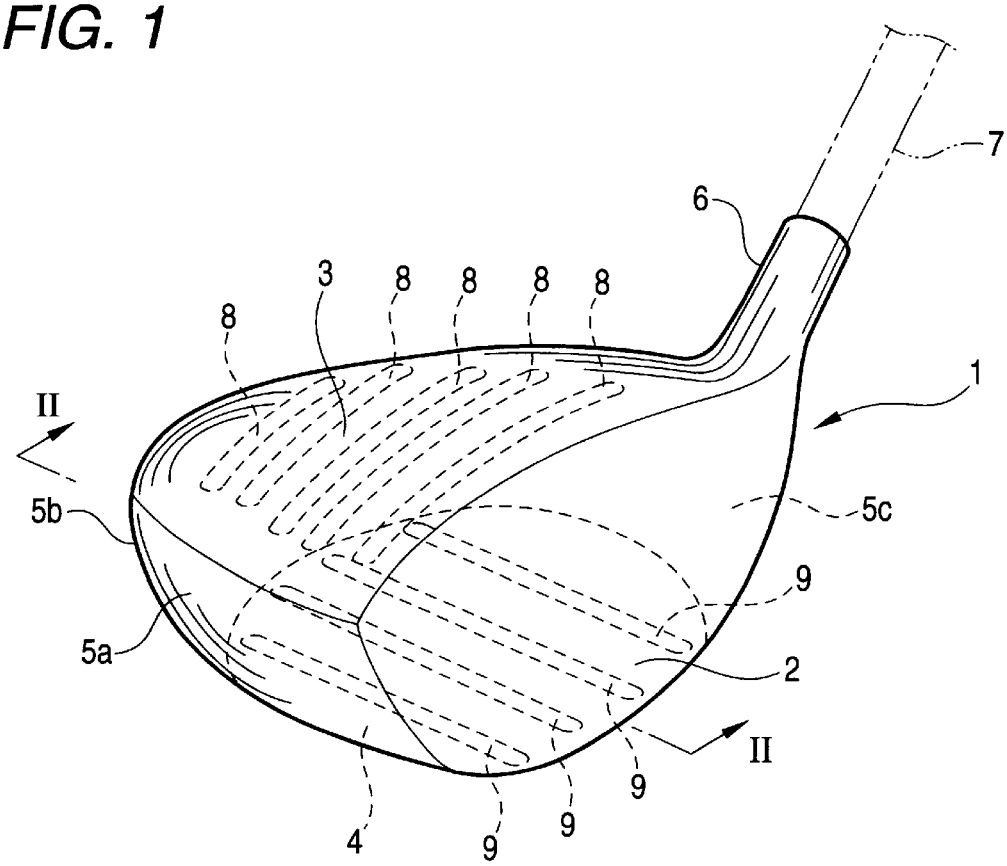
FIG. 1 is a perspective view of a golf club head according to an embodiment of the invention.
Figure 2:
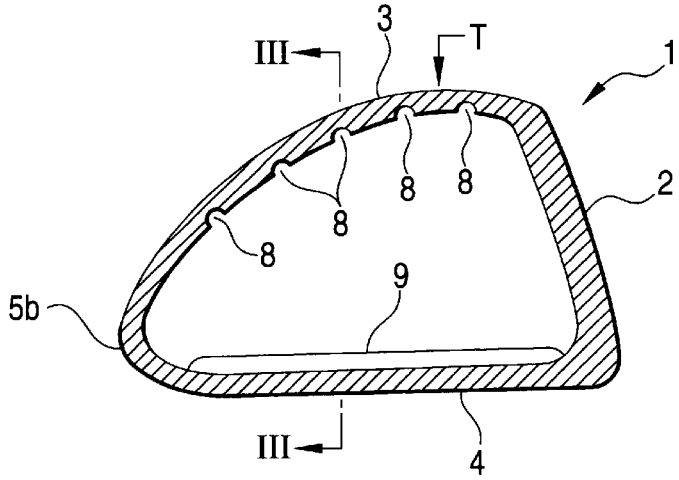
FIG. 2 is a sectional view taken on line II—II in FIG. 1.
Figure 3:
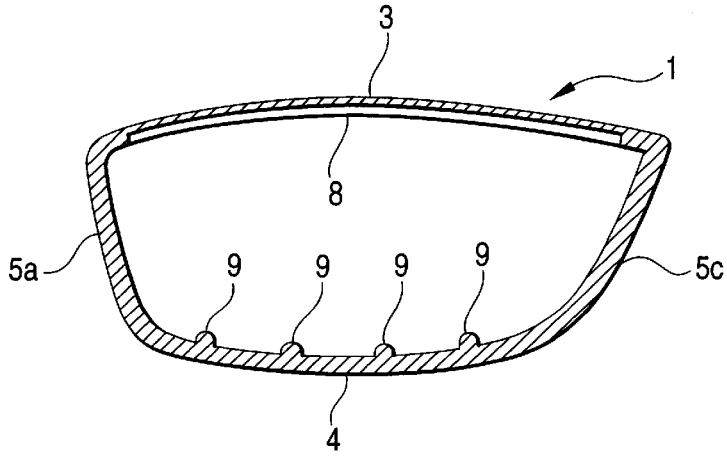
FIG. 3 is a sectional view taken on line III—III in FIG. 2.

An embodiment of the invention will be described below with reference to the drawings. FIG. 1 is a perspective view of a golf club head 1 according to an embodiment of the invention. FIG. 2 is a sectional view taken on line II—II in FIG. 1. FIG. 3 is a sectional view taken on line III—III in FIG. 2.

The golf club head 1 is made of metal and has a hollow portion. The golf club head 1 has a face portion 2, a crown portion 3, a sole portion 4, a toe-side side portion 5*a*, a back-side side portion 5*b*, a heel-side side portion 5*c* and a hosel portion 6. The back-side side portion 5*b* is disposed in the back portion of the golf club head 1 so as to connect the side portions 5*a* and 5*c*. In this embodiment, the toe-side, back-side and heel-side side portions, the face portion, the crown portion and the hosel portion are cast integrally, while the sole portion 4 is welded thereto.

A plurality of grooves 8 are provided in the crown portion 3 so as to extend substantially straight lines from the toe-side side portion 5*a* toward the heel-side side portion 5*c*. Incidentally, a highest portion T on the crown portion excluding the hosel portion 6 is disposed between the grooves 8 and 8. That is, the grooves 8 are disposed not to pass the highest portion T.

A rib 9 is provided in the inner surface of the sole portion 4 so as to extend from the face portion 2 toward the back-side side portion 5*b*. In this embodiment, a plurality of ribs 9 are provided (number of ribs 9 may be one). In addition, the ribs 9 extend substantially in parallel with one another and substantially perpendicularly (preferably at an angle of 90°±10°, more preferably 90°±5°) to the face portion 2.

In the golf club head 1 configured thus, the crown portion 3 is easily bent at the time of impact because the plurality of grooves 8 are provided in the crown portion 3. In addition, in this embodiment, the ribs 9 provided in the sole portion 4 makes the sole portion 4 difficult to bend at the time of impact, so as to facilitate the concentration of stress on the crown portion.

As a result, even if a player having a low head speed uses the golf club head, the crown portion 3 bends sufficiently at the time of impact so that large repulsion can be obtained. Thus, the initial speed of a ball increases while the rate of backspin also increases. In addition, the launch angle also increases. By these operations, a large carry can be obtained even if a player having a low head speed (for example, a player having a head speed of about 43 m/sec or lower) uses the golf club head.

Particularly, since the grooves 8 do not pass the highest portion T in this embodiment, the stress at the time of impact is propagated easily all over the crown portion. (Incidentally, if a groove 8 passed the highest portion T, there is a fear that the stress at the time of impact would be concentrated on this groove so that the crown portion might bend locally on a large scale.) Thus, extremely large repulsion can be obtained.

Figure 4:
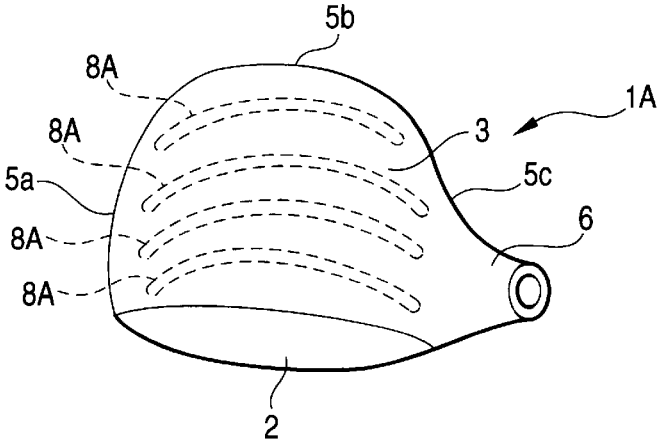
FIG. 4 is a top view of a golf club head according to another embodiment.

The grooves 8 are formed like substantially straight lines in the embodiment. However, grooves 8A shaped like curves bent to bulge toward the back-side side portion 5*b* may be provided as in a golf club head 1A shown in FIG. 4 (top view). This is because balls are often hit near the center of the face portion 2 in a normal case so that the stress applied from the face portion 2 to the crown portion 3 is often propagated radially from the center of the face portion 2.

Figure 5:
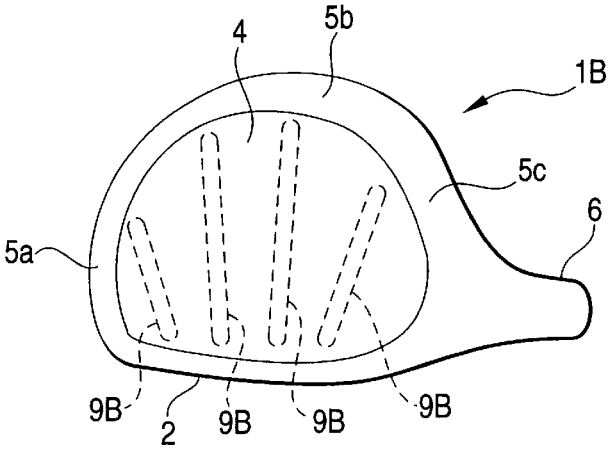
FIG. 5 is a bottom view of a golf club head according to a further embodiment.
Figure 6:
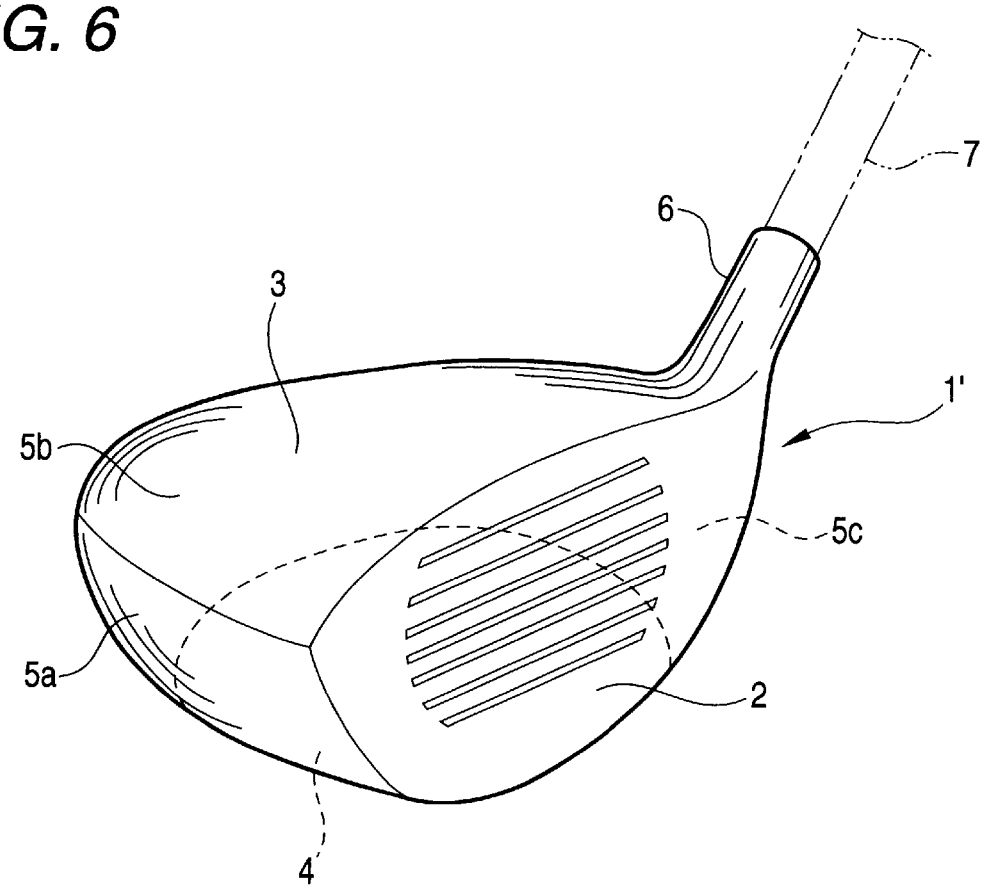
FIG. 6 is a perspective view of a related-art golf club head.

For the same reason, as in a golf club head 1B shown in FIG. 5 (bottom view), ribs 9B may be provided in the sole portion 4 radially so that each distance between the ribs 9B increases as they go away from the face portion 2.

Incidentally, it is preferable that the ribs are enlarged or thickened to make the sole portion difficult to bend. In such a manner, the center of gravity of the golf club head can be made low.

It is preferable that the head is produced by casting because it is easy to create grooves or ribs. However, when a plate material is used, grooving by carving or the like may be carried out. Alternatively, grooves or ribs may be provided at the time of rolling. It is therefore possible to produce the head by casting or press molding. The golf club head may be produced by use of one and the same metal material as a whole, or may be produced in combination of different kinds of metal materials. When the golf club head is produced by use of one and the same material as a whole, respective portions can be joined easily by welding.

Examples of a metal material for forming the golf club head include a copper alloy, maraging steel, stainless steel, a titanium alloy, and an aluminum alloy. Of them, a titanium alloy or an aluminum alloy is preferred.

It is preferable that the metal has a longitudinal elastic modulus of 12,000 kgf/mm$^2$ ($11.76\times10^6$ Pa) or lower. By use of such metal having a low longitudinal elastic modulus, the crown portion can be made easy to bend. The longitudinal elastic modulus of a titanium alloy is generally in a range of 8,000–12,000 kgf/mm$^2$, and the longitudinal elastic modulus of an aluminum alloy is approximately 7,000 kgf/mm$^2$.

It is preferable that the thickness of the crown portion 3 excluding the groove portions is not larger than 1.2 mm, especially not larger than 1.0 mm in order to make the crown portion 3 easy to bend. Incidentally, in order to secure the strength, it is preferable that the thickness of the crown portion 3 is not smaller than 0.5 mm, especially not smaller than 0.7 mm. Since balls are not hit on the crown portion 3 directly, it is sufficient that the thickness of the crown portion 3 is not larger than half of the thickness of the face portion 2.

The sectional shape of each groove is preferably a U-shape, a semicircle, a semiellipse, a trapezoid, a rounded V-shape, or the like.

It is preferable that the depth of each groove is in a range of about 25% to about 60% of the thickness of the crown portion, and it is preferable that the width of each groove is in a range of about 0.5 mm to about 3.0 mm, especially about 0.7 mm to about 2.0 mm. It is preferable that each groove has a length of about 50%–95% of the golf club head width in the direction including the opposite ends of the groove. When the grooves are formed to have such thickness and dimensions, the bending of the golf club head when a player having a low head speed hits a ball becomes appropriate. The grooves may be provided all over the crown portion, or may be provided only near the face portion 2. It is, however, preferable that at least one of the groove 8 is present within a range of 40 mm from the face portion. It is preferable that the number of the grooves is in a range of 1 to 15, especially in a range of 3 to 8.

It is preferable that the thickness of the sole portion 4 (thickness of any portion excluding the ribs 9) is in a range of about 1 mm to about 2 mm. It is preferable that the height of each rib is in a range of about 0.5 mm to about 3 mm, and the width of the base portion of each rib is in a range of about 2 mm to about 10 mm.

It is preferable that the length of each rib is in a range of about 40% to about 100% of the sole portion length in the front/rear direction including the opposite ends of the rib. It is desired that the length is not smaller than 40 mm. The ribs may extend all over the sole portion, or may be provided only on the side close to the face portion 2. It is preferable that the number of the ribs is in a range of 1 to 10, especially in a range of 2 to 6.

Although the ribs 9 are provided in the sole portion 4 so as to make the sole portion 4 difficult to bend at the time of impact in the embodiment, salient portions (ridge-like protrusion strips where two faces intersect each other) may be provided in the bottom surface of the sole portion 4 so as to extend from the face portion 2 toward the back-side side portion 5*b*.

EXAMPLE 1

A sole portion 4 and a portion other than the sole portion 4 were produced by casting by use of a Ti-6Al-4V titanium alloy respectively. These portions were joined by welding so as to produce a golf club head for a driver having a volume of 300 cc.

Incidentally, the thickness and so on of each portion are as follows.

| | |
|---|---|
| face portion thickness: | 2.8 mm (uniform) |
| crown portion thickness: | 1.2 mm (excluding groove portions) |
| sectional shape of groove: | U-shape |
| groove depth: | 0.6 mm |
| groove width: | 1.5 mm |
| number of grooves: | 4 |
| lengths of grooves: | 70 mm, 80 mm, 70 mm and 60 mm from the face side |
| positions of grooves: | Each groove extends in parallel with the face portion. The distances from the face portion are 10 mm, 22 mm, 34 mm and 46 mm, respectively. |
| thickness of sole portion: | 1.2 mm (excluding ribs) |
| number of ribs: | 4 |
| lengths of ribs: | 0.8 mm × 2 (heel-side and toe-side). 1.2 mm × 2 (center-side). |
| width of rib base portion: | 2.5 mm |
| lengths of ribs: | 55 mm, 70 mm, 70 mm, and 55 mm from the heel side |
| positions of ribs: | Each rib extends from the face portion and perpendicularly thereto. The distances of the ribs from each other is 25 mm. Of the four ribs, the midpoint of the two center-side ribs is located at the face center. |

A 45-inch (114 cm) carbon shaft was attached to this golf club head. Thus, a golf club was produced. Table 1 shows the test shot evaluation results of the golf club head with a swing robot (head speed 43.1 m/sec).

Comparative Example 1

A golf club was produced and evaluated in the same manner as that in Example 1, except that no groove and no rib were provided. The result is shown in Table 1.

TABLE 1

| | head speed (m/s) | ball initial speed (m/s) | launch angle (degree) | back spin (rpm) | carry (m) | total distance (m) |
|---|---|---|---|---|---|---|
| the invention | 43.1 | 60.1 | 9.1 | 2,783 | 200 | 228 |
| Comp. Ex. | 43.2 | 59.8 | 8.6 | 2,722 | 197 | 224 |

As shown in Table 1, in the golf club head according to the invention, the launch angle increased by about 0.50 in comparison with that of the golf club head according to Comparative Example. In addition, the carry increased by 3 m, and the total distance increased by 4 m.

As described above, in a golf club head according to the invention, the launch angle increases even if a golfer having a low head speed uses the golf club head. Thus, the carry can be increased.

What is claimed is:

1. A hollow golf club head made of metal, the golf club comprising:

a face portion;

a sole portion;

a toe-side side portion;

a heel-side side portion;

a back-side side portion;

a crown portion; and a hosel portion, wherein a plurality of grooves are defined in the crown portion to extend from the toe-side side portion toward the heel-side side portion, wherein the plurality of the grooves are provided on an interior of the hollow club head.

2. The golf club head according to claim 1, wherein the grooves are formed in substantially straight lines.

3. The golf club head according to claim 1, wherein the grooves are formed in curved lines and are bent to bulge toward the back-side side portion.

4. The golf club head according to claim 1, wherein a highest portion of the crown portion excluding the hosel portion is located between two of the grooves.

5. The golf club head according to claim 1, wherein the crown portion except for the grooves has thickness in a range of from 0.5 mm to 1.2 mm.

6. The golf club head according to claim 5, wherein each of the grooves has depth in a range of from 25% to 60% of the thickness of the crown portion.

7. The golf club head according to claim 1, wherein each of the grooves has width in a range of from 0.5 mm to 3.0 mm.

8. The golf club head according to claim 1, wherein each of the grooves has length in a range of from 50% to 95% of a width of the golf club head in a direction including both ends of the grooves.

9. The golf club head according to claim 1, wherein at least one of the grooves is present within a range of 40 mm from the face portion.

10. The golf club head according to claim 1, wherein a number of grooves is in a range of 1 to 15.

11. The golf club head according to claim 1, wherein ribs are provided on the sole portion to extend from the face portion toward the back-side side portion.

12. The golf club head according to claim 11, wherein the ribs are in parallel to each other and substantially perpendicular to the face portion.

13. The golf club head according to claim 11, wherein the ribs are provided radially so that each distance between the ribs increases as the ribs go away from the face portion.

14. The golf club head according to claim 11, wherein the sole portion excluding the ribs has thickness in a range of from 1 mm to 2 mm.

15. The golf club head according to claim 11, wherein each of the ribs has height in a range of from 0.5 mm to 3 mm.

16. The golf club head according to claim 11, wherein a base portion of each of ribs has width in a range of from 2 mm to 10 mm.

17. The golf club head according to claim 11, wherein each of the ribs has length in a range of from 40% to 100% of a length of the sole portion in a front/rear direction including both ends of each of ribs.

18. The golf club head according to claim 11, wherein a number of the ribs is in a range of from 1 to 10.

19. The golf club head according to claim 11, wherein the ribs are provided on an interior of the hollow club head.

20. The golf club head according to claim 1, wherein salient portions are provided on a bottom surface of the sole portion to extend from the face portion toward the back-side side portion.

21. The golf club head according to claim 20, wherein the salient portions are provided on an interior of the hollow club head.

22. A hollow golf club head made of metal, the golf club comprising:

a face portion;

a sole portion;

a toe-side side portion;

a heel-side side portion;

a back-side side portion;

a crown portion; and a hosel portion, wherein a plurality of grooves are defined in the crown portion to extend from the toe-side side portion toward the heel-side side portion, wherein the grooves are formed in curved lines and are bent to bulge toward the back-side side portion.

23. A hollow golf club head made of metal, the golf club comprising:

a face portion;

a sole portion;

a toe-side side portion;

a heel-side side portion;

a back-side side portion;

a crown portion; and a hosel portion, wherein a plurality of grooves are defined in the crown portion to extend from the toe-side side portion toward the heel-side side portion, further wherein ribs are provided on the sole portion to extend from the face portion toward the back-side side portion.

24. The golf club head according to claim 23, wherein the ribs are in parallel to each other and are substantially perpendicular to the face portion.

25. The golf club head according to claim 23, wherein the ribs are provided radially so that each distance between the ribs increases as the ribs go away from the face portion.

26. A hollow golf club head made of metal, the golf club comprising:

a face portion;

a sole portion;

a toe-side side portion;

a heel-side side portion;

a back-side side portion;

a crown portion; and a hosel portion, wherein a plurality of grooves are defined in the crown portion to extend from the toe-side side portion toward the heel-side side portion, and further wherein salient portions are provided on a bottom surface of the sole portion to extend from the face portion toward the back-side side portion.

* * * * *